US005531481A

United States Patent [19]

Wiltshire

[11] Patent Number: 5,531,481

[45] Date of Patent: Jul. 2, 1996

[54] MEMO PAD ASSEMBLY

[76] Inventor: Curtis B. Wiltshire, 11 Nomas La., Richmond, Va. 23233

[21] Appl. No.: 421,994

[22] Filed: Apr. 14, 1995

[51] Int. Cl.[6] ..... B42D 17/00

[52] U.S. Cl. ..... 281/44; 281/51; 281/45; 224/219; 224/267

[58] Field of Search ..... 281/15.1, 28, 44, 281/45, 51; 402/4; 40/640; 224/219, 267

[56] References Cited

U.S. PATENT DOCUMENTS

| | | | |
|---|---|---|---|
| 1,407,239 | 2/1922 | Weiss | 281/51 |
| 1,419,190 | 6/1922 | Zipoy | 281/44 |
| 4,243,249 | 1/1981 | Goss | 281/1 |
| 4,824,140 | 4/1989 | Rankin | 281/8 |
| 4,903,932 | 2/1990 | Stewart, Jr. | 281/45 X |
| 4,906,025 | 3/1990 | Schreindl | 281/45 |
| 5,311,689 | 5/1994 | Lindsey | 283/81 |

*Primary Examiner*—Willmon Fridie, Jr.
*Attorney, Agent, or Firm*—J. Michael Martinez de Andino

[57] ABSTRACT

A memo pad assembly that is adapted to be worn around a person's wrist, or other body parts, or clothing, and which has several containers that have first slots formed within the containers; a strap that has a center portion, and first and second ends, which have a releasably securing means attached thereto; and a compartment section that is attached to the strap's center portion and which has a rear side with an outer surface, a second slot formed within the compartment section, and a drawer removably stored within the second slot. The memo pad assembly also has sheets of paper removably stored within the drawer and which are adapted to be removably inserted in the first slots of the containers; and a writing instrument section located adjacent to the compartment section and which includes a writing instrument and a shelf extension that is attached to the outer surface of the rear side of the compartment section and has a third slot formed in the shelf extension. The writing instrument is adapted to be removably stored in the third slot. The memo pad assembly may include a shelf section located above the compartment section that has several shelves and a support end, with the shelves attached to the support end to form a series of fourth slots. The support end is connected to the compartment section, with each of the fourth slots adapted to receive one of the containers.

21 Claims, 4 Drawing Sheets

MEMO PAD ASSEMBLY

BACKGROUND OF THE INVENTION

1. Field of the Invention

This invention relates to the field of writing notes and memorandum and, more specifically, to a memo pad assembly that allows the user to wear on the user's wrist, ankle or another part of a user's body a memo pad assembly with removably, stacked holding containers for storing therein a note or memo, and to make, send, trade or collect personal notes or memos stored within such holding containers.

2. Background Information

Conventional methods have been developed that allow individuals to write personal notes and memos, and that allow a user to make reminders of special or important information while also allowing the user to wear the writing device. Prior art devices such as the Weiss U.S. Pat. No. 1,407,239 Wrist Tablet, the Zipoy U.S. Pat. No 1,419,190 Memorandum Pad, the Goss U.S. Pat. No. 4,243,249 Document Holder Assembly, the Rankin U.S. Pat. No. 4,824,140 Wrist Note Pad, and the Lindsey U.S. Pat. No. 5,311,689 Personal Memo Device are examples of such conventional methods.

The Weiss U.S. Pat. No. 1,407,239 is directed toward a wrist tablet that includes a holder, a supporting device, a tablet, a protector cover and a writing instrument holder. The holder is attached to the supporting device, which includes a strap that is fastened about a person's wrist. The writing instrument holder has a pencil inserted therein. The tablet is disclosed to be a slate that can written upon and then cleaned off when desired. The Weiss '239 patent also discloses that the tablet can be a small tablet of writing paper.

The Zipoy U.S. Pat. No. 1,419,190 is directed toward a memo pad having a plate with a reduced extension at one end thereof. The plate and the extension have a cover made up of leather or the like. The extension is curved in shape to wrap around an individual's wrist. The plate has a fastening screw that is used to detachably hold a writing pad to the plate.

The Goss U.S. Pat. No. 4,243,249 is directed toward a document holder for use by a pilot or navigator to maintain a log and for access to data. The document holder includes a support base that forms a plate with a generally circular shape and has a centrally-located opening for inserting a screw therethrough. The support base has fastening straps that allow the document holder to be secured to a person's leg. A carrier plate, which has a clamp assembly located at the top of the carrier plate, is fastened to the support base.

The Rankin U.S. Pat. No. 4,824,140 is directed toward a wrist note pad that has an elongated housing attached to a wrist fastening band. The housing has a writing surface cover attached by a hinge at the top of the housing. A scrolled paper roll is inserted within the housing. A rewind knob is used to move the paper along the surface of the housing for writing thereon.

The Lindsey U.S. Pat. No. 5,311,689 is directed toward a personal memo device to be worn around a wrist. The memo device has a message-receiving portion upon which a message can be written. The device can include a security flap that can be folded over so that any written message cannot be readily visible to others. The patent discloses that the memo device can be stacked and assembled into pads such that once a message is written on the message-receiving portion of the memo device, the top-most memo device can then be removed from the pad and placed around a person's wrist.

Prior art devices, which include the above-mentioned, require the user to either use a slate, a single piece of paper or a scroll of paper, which must be manually rotated to allow a user to write on the scroll of paper, or the use of a pad of writing paper that is attached to a support plate. Further, the prior art devices require the user to either dispose of the memo device once its writing surface has been written upon, such as in the Lindsey '689 Personal Memo Device, or to erase or rotate a scroll of writing paper before being able to use the writing surface. Also, the prior art devices do not disclose the use of a memo pad assembly that has a plurality of removably, stacked holding compartments which can have a written memo or note inserted therein, and may have a transparent or non-transparent surface, which can also act as a protectable cover. Moreover, the prior art devices do not disclose a memo pad assembly that includes the use of a compartment having a pad of writing paper stored within the compartment, with a plurality of removably, stacked holding containers attached to the compartment and that can have see through top surfaces that allow an individual to read a note or a writing on a note paper that has been inserted into a holding container, and a top cover that covers the upper most holding container.

In order to overcome the above-mentioned defects there is a need for a memo pad assembly that allows individuals to quickly and easily write personal notes or memos without having to turn a scroll of paper, and which can then be inserted within a removably, stacked holding container for protection thereof. There is also a need for a memo pad assembly that includes a pad of writing paper stored within a compartment with a writing instrument attached thereto, a plurality of removably, stacked holding containers, a top cover for the upper-most holding container, and which allows a person to write a note and insert the note into a holding container, remove the holding container from the memo pad assembly and hand the holding container to another person for the other person's reading. The note within the removed holding container can easily be read and would still be protected from the elements.

SUMMARY OF THE PRESENT INVENTION

Accordingly, it is the primary object of the present invention to provide a memo pad assembly that includes a plurality of removably, stacked holding containers for inserting therein a written note or memo, which can then be easily removed from the memo pad assembly and handed to another for the other person's reading.

It is a further object of this invention to provide a memo pad assembly that has a writing pad stored within a compartment with a writing instrument attached thereto, and which includes a plurality of removably, stacked holding containers for inserting therein a written note or memo and which may have a transparent or non-transparent top surface that allows a person to read a note or memo stored therein, with the upper-most holding container having a cover or cap removably attached thereto.

It is another object of this invention to provide a memo pad assembly that allows the user to write a personal note, insert the note into a holding container, which allows the user to either keep the written note stored for future reading or to hand the written note to another person for the other person's reading.

It is still another object of this invention to provide a memo pad assembly that is durable and efficient in use, one that is simple and easy to manufacture, and one which can be placed upon the market at a reasonable cost and that can be used on a person's wrist, attached to a person's belt or to other parts of the body, such as the ankle.

Other objects and advantages of this invention will become apparent from the following description taken in connection with the accompanying drawings wherein are set forth, by way of illustration and example, certain embodiments of this invention.

DETAILED DESCRIPTION OF THE PREFERRED EMBODIMENTS

1. DESCRIPTION

Figure 1:
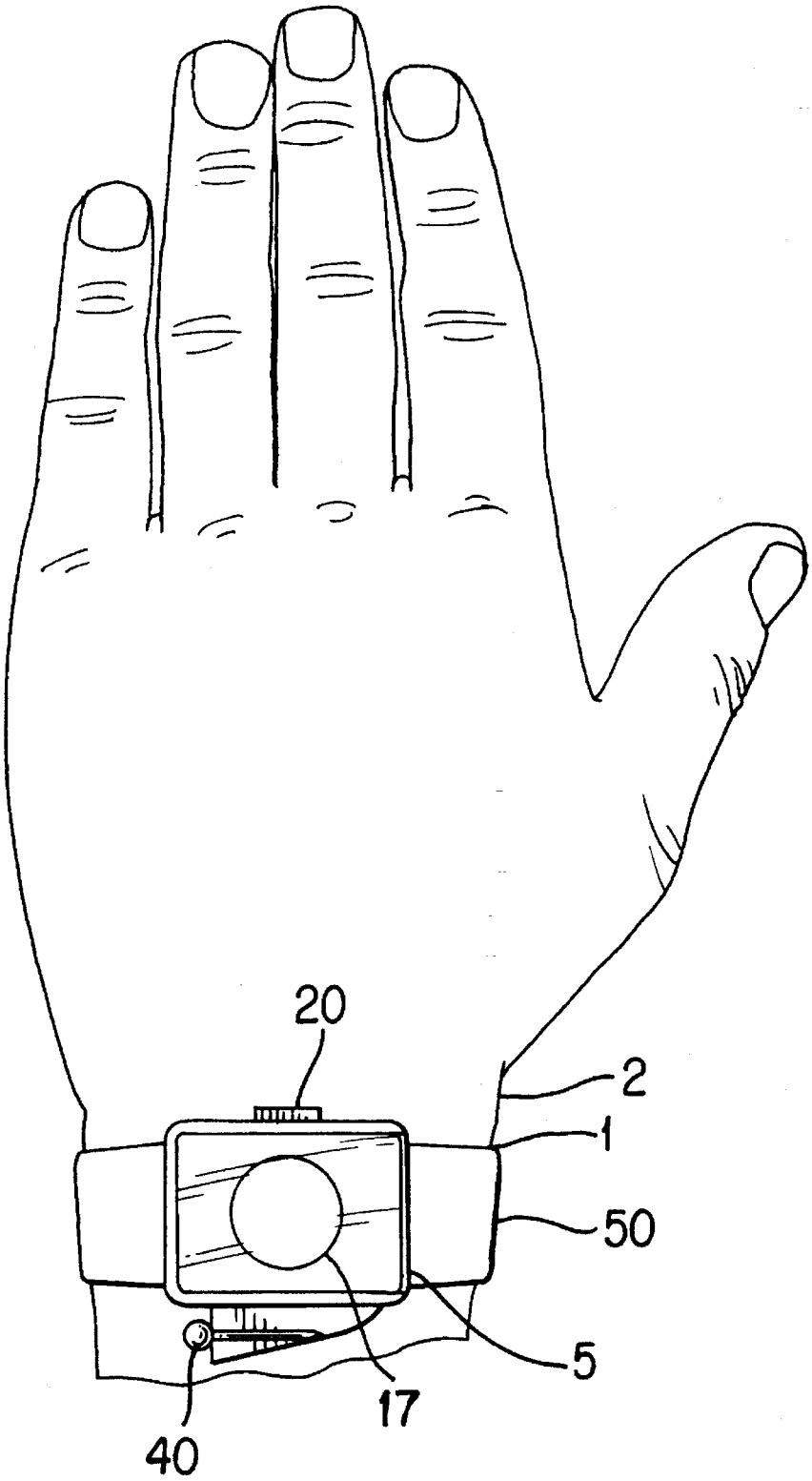
FIG. 1 is a top plan view of a typical embodiment of the invention showing the invention fastened to a person's wrist.

Referring now to the drawings, an embodiment of a memo pad assembly is indicated generally as 1 in FIG. 1. The assembly 1 is adapted to be worn around the wrist 2 of a user, but can also be worn around an ankle or a piece of clothing. The assembly 1 is an innovative way to conveniently pass notes to others, make reminders, send memos, or trade and collect component parts as will be described in more detail below. The assembly 1 can be preferably made of plastic or flexible rubber, but can be made of almost any type of durable material. The assembly 1 can also be made in any color. As shown in FIGS. 1–3 and 10, the assembly 1 comprises a shelf section 5, a plurality of holding containers 18, a compartment section 20, a writing instrument section 40, and a fastening strap 50.

2. THE SHELF SECTION

Figure 3:
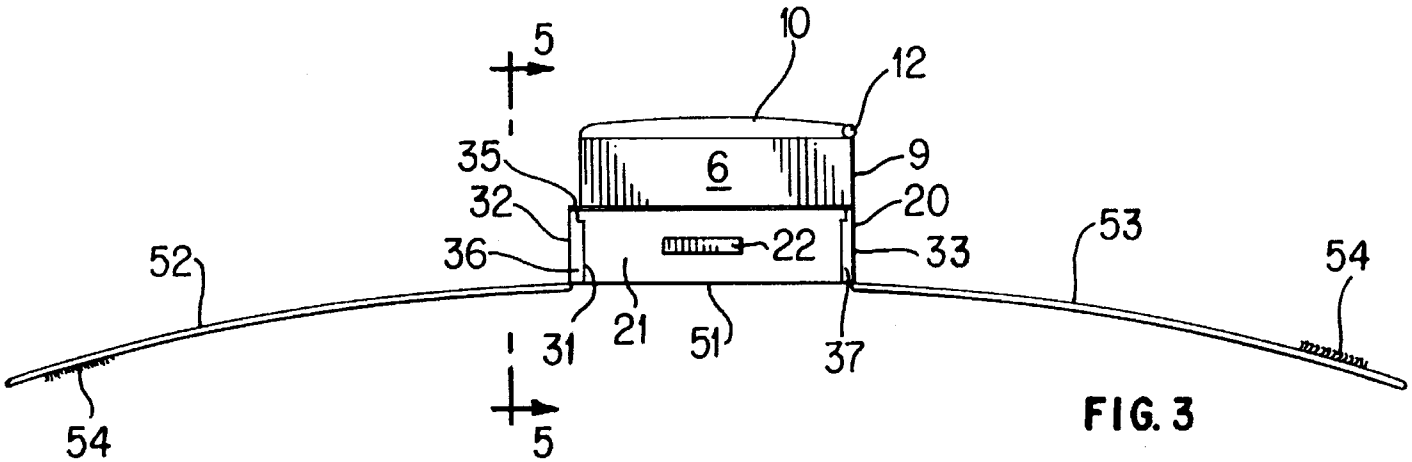
FIG. 3 is a side plan view of the invention taken along lines 3—3 of FIG. 2 showing the removably, stacked holding containers and the compartment for storing a writing pad therein.
Figure 2:
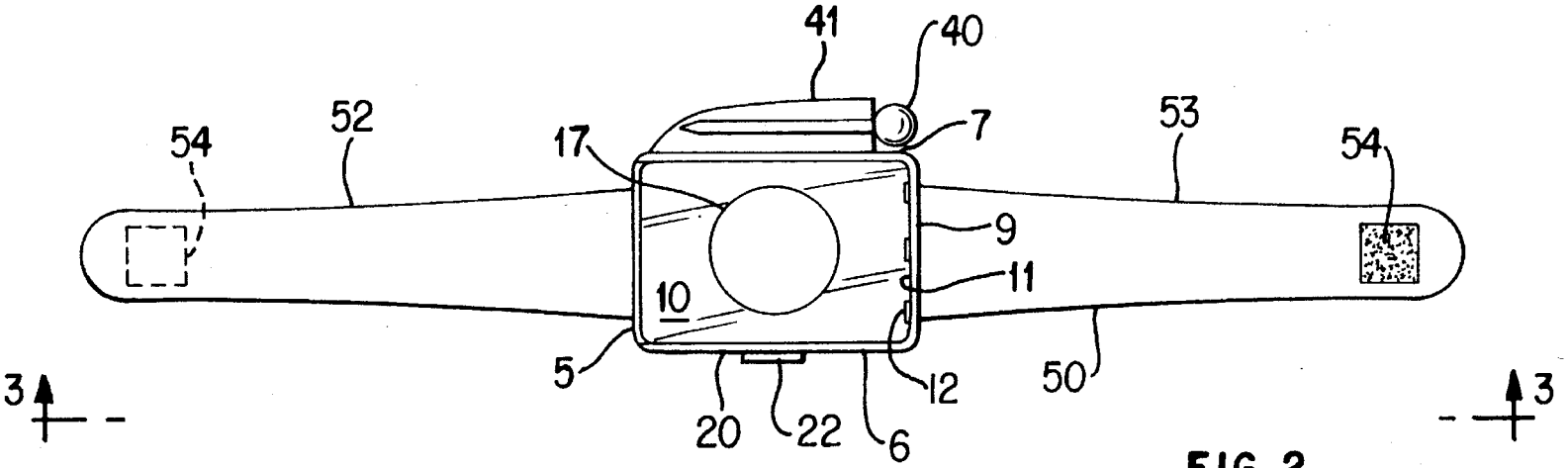
FIG. 2 is a top plan view of the invention showing a clock mechanism stored within the top cover, the writing instrument and straps for attaching the invention to a person's wrist, ankle, or other part of a person's body or clothing.
Figure 5:
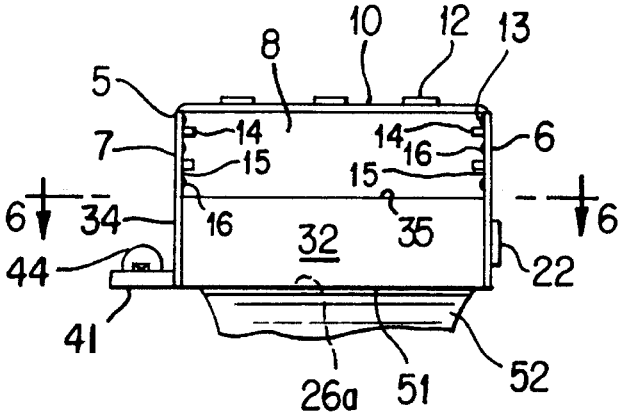
FIG. 5 is a side plan view of the invention taken along lines 5—5 of FIG. 3 showing the shelves and the top cover of the shelf section, with the holding containers removed from the shelves.

As shown in FIGS. 2, 3 and 5, the shelf section 5 is located above the compartment section 20, and has first and second sides 6 and 7 that are rectangular in shape, but which can have other shapes, and that are spaced apart from each other. The shelf section 5 also has an insert side 8 and a support end 9 that are attached on opposite ends of the first and second sides 6 and 7, and a top cover 10. The insert side 8 is adapted to allow the user to insert holding containers 18 within the shelf section 5. The support end 9 forms the back wall for the shelf section 5 and is attached to the compartment section 20.

The first and second sides 6 and 7 have shelf extensions 14 protruding from the inside surfaces 15 of the first and second sides 6 and 7. The inside surfaces 15 also have prong extensions 16 protruding from the inside surfaces 15 that together with the shelf extensions 14 are adapted to receive and removably maintain holding containers 18 within the shelf section 5.

The support end 9 is rectangular in shape and is approximately 1 to 1¼ inches in length and ¼ to ½ inch in height, but can have other shapes or dimensions. As shown in FIGS. 2, 3 and 5, the support end 9 is attached to the compartment section 20. The first and second sides 6 and 7 are connected to and supported by the support end 9. The top cover 10 has a connecting end 11 that is connected to the support end 9 by hinges 12. The top cover 10 can be solid in color or have an image or drawing laminated or inserted within the top cover for viewing by the user or other persons. The top cover 10 can also have a clock mechanism 17 mounted within the outer surface of the top cover 10.

Figure 10:
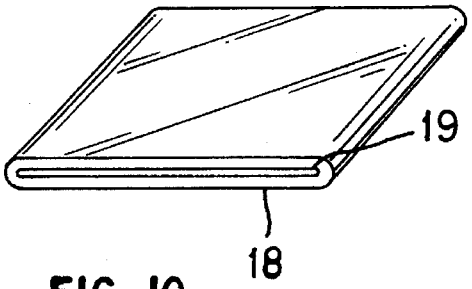
FIG. 10 is a perspective view of a holding container showing the slot for inserting a folded sheet of paper from the writing pad therein.

The shelf extensions 14, together with the top cover 10 and the top surface of the compartment section 20 form slots 13. The holding containers 18, shown in FIG. 10, are thin, elongated rectangular containers that have slots 19 that extend almost the entire length of the holding containers 18. The holding containers 18 can also be designed to have the slots 19 extend almost the entire width of the holding containers 18. The holding containers 18, which are approximately 1 inch wide and 1¾ inch in length, can be removably inserted within the slots 13 of the shelf section 5 for storage therein. The slots 19 of the holding containers 18 are wide enough to allow a person to insert a folded piece of paper therein. The holding containers 18 can be made of: (i) clear see-through synthetic plastic material, or other clear material, (ii) non-transparent material, or (iii) can have artwork or some other type of graphic or pictorial representation attached to the outer surface of the holding containers 18.

3. THE COMPARTMENT SECTION

Figure 4:
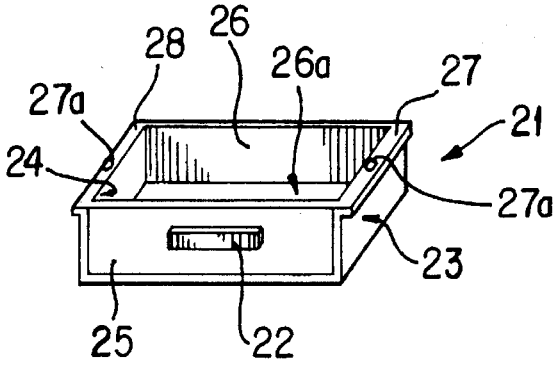
FIG. 4 is a perspective view of the drawer that is inserted into the compartment.

Referring now to FIGS. 2–4, the compartment section 20 is shown having a drawer 21 that is placed within a slot 31 formed by spaced apart opposite sides 32 and 33 that are attached to a back end 34 and a top surface 35. The spaced apart opposite sides 32 and 33 have edges 36 and 37, respectively, that form the entrance of the slot 31. The back end 34 has a rectangular shape which is approximately 1¾ to 2 inches in length and ¼ to ½ inches in height, but can have other shapes and dimensions. The back end 34 is attached to and extends up from the fastening strap 50 and is connected to the top surface 35.

The drawer 21, as shown is FIGS. 4–7, is inserted within the slot 31 of the compartment section 20. The drawer 21 has spaced apart opposite sides 23 and 24 that are connected to front and back sides 25 and 26, respectively, and which are all attached to a bottom plate 26*a*. The drawer 21 may have spaced apart opposite sides 23 and 24 that have shelf extensions 27 and 28, respectively, located at and extending along the top edges of the spaced apart opposite sides 23 and 24 that assist in guiding and supporting the drawer 21 within the slot 31. The shelf extensions 27 and 28 may have shelf wedge extensions 27*a* that extend slightly from the top surface of the shelf extensions 27 and 28, and which assist in maintaining the drawer 21 within the slot 31.

Figure 6:
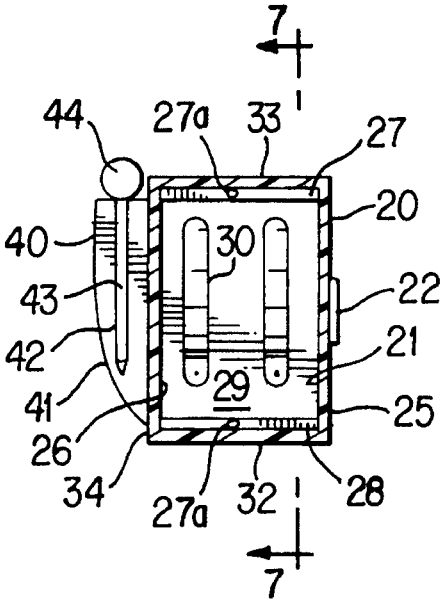
FIG. 6 is a top plan view of the compartment and the writing instrument section taken along lines 6—6 of FIG. 5.
Figure 7:
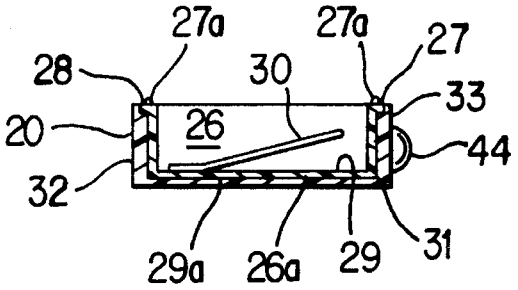
FIG. 7 is a side plan view of the compartment taken along lines 7—7 of FIG. 6 showing the hinged elevators.
Figure 8:
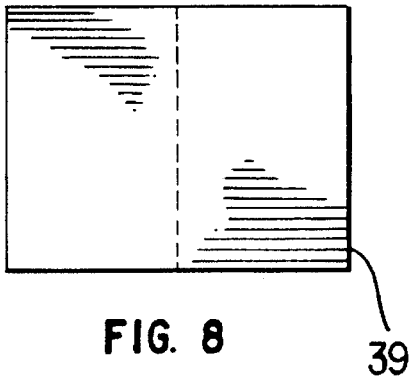
FIG. 8 is a top plan view of an un-folded sheet of writing paper from the writing pad.
Figure 9:
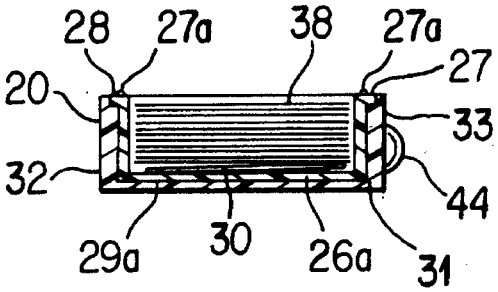
FIG. 9 is a side plan view of the compartment taken along lines 7—7 of FIG. 6 with folded sheets of writing paper stored within the drawer.

As shown in FIGS. 6, 7 and 9, the bottom plate 26*a* has a top surface 29 that has hinged elevators 30 attached thereto for raising or lifting the folded sheets of paper 38, which are stored within the drawer 21, for easy access when the user pulls the drawer 21 open. The bottom plate 26*a* may have a wedge extension (not shown) extending from the bottom surface 29*a* of the bottom plate 26*a* to assist in maintaining the drawer 21 within the slot 31. Also, the top surface 35 may have a wedge extension (not shown) extending from the top surface 35 to assist in maintaining the drawer 21 within the slot 31. As shown in FIG. 8, when unfolded, the piece of paper 39 has sufficient amount of space to allow a user to write a note, memo or other important notations thereon.

The drawer 21 may alternatively be designed such that it does not have the hinged elevators 30 attached therein. Further, the assembly 1 can have a pad of paper (not shown) stored within the drawer 21, instead of the folded sheets of paper 38.

4. THE WRITING INSTRUMENT SECTION

Referring now to FIGS. 2, 5 and 7, the writing instrument section 40 is shown to include a holder 41, a slot 42 formed within the top surface of the holder 41, a pen, pencil or other writing instrument 43 stored within the slot 42 that has a spherical shaped end 44 that assists the user in easily removing the writing instrument 43 from the slot 42. The writing instrument 43 can have a telescoping body that allows a user to extend the spherical shaped end 44 from the writing end, which allows the writing instrument 43 to have an overall length of approximately 2 to 3 inches. The holder 41 is located adjacent to and integral with the bottom edge of the back end 34 of the compartment section 20.

5. THE FASTENING STRAP

The compartment section 20 is attached to the center portion 51 of the fastening strap 50. The fastening strap 50 has spaced apart opposite ends 52 and 53 that have attaching means 54, such as, but not limited to, VELCRO, buttons, a buckle, snaps or hooks, connected thereto for fastening the assembly 1 around the wrist, ankle, or other body part, or to a person's clothing.

6. ALTERNATE EMBODIMENT

Figure 11:
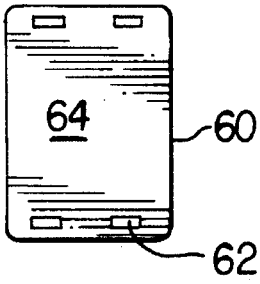
FIG. 11 is a top plan view of a holding container of an alternative embodiment of the invention.
Figure 12:
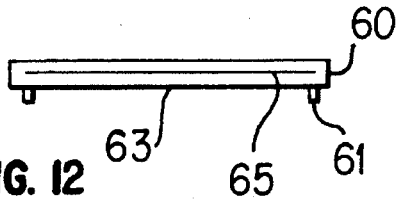
FIG. 12 is a side plan view of a holding container of an alternative embodiment of the invention.
Figure 13:
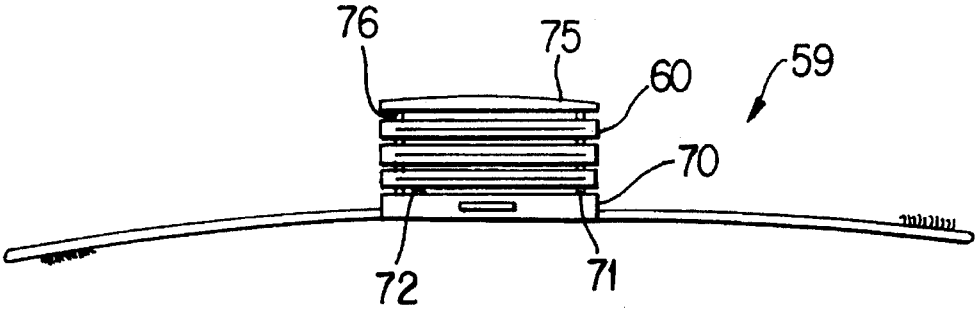
FIG. 13 is a side plan view of an alternative embodiment of the invention.

An alternate embodiment of the memo pad assembly is shown in FIGS. 11–13 and is indicated by 59. The assembly 59 has holding containers 60, a compartment section 70 and a top cover 75. The holding containers 60, while similar to the holding containers 14, will have four prongs 61, slots 62, bottom and top surfaces 63 and 64, respectively, and an elongated slot 65 formed between the bottom and top surfaces 63 and 64. The prongs 61 extend from each corner of the bottom surfaces 63 of the holding containers 60. The slots 62 are formed within and near each of the corners of the top surfaces 64 of each of the holding containers 60.

The compartment section 70 differs from the compartment section 20, by having four slots 71 formed within and located near each corner of the top surface 72 of the compartment section 70. The top cover 75 is similar to the top cover 10, but has four prongs 76 extending from each corner of its bottom surface.

The user can remove the top cover 75 from the assembly 59 by pulling on the top cover 75, thereby removing the prongs 76 from the slots 62 of the upper-most holding container 60. The user can remove a sheet of paper from the compartment section 70 and write a note or memo thereon. The user can remove the upper-most holding container 60 from the assembly 59 by pulling on it, thereby releasing its prongs 61 from the slots 62 of the adjacent holding container 60. The user may then fold the memo or note and insert the folded sheet of paper into the slot 65 of the released holding container 60 for future storage or use. The user may easily re-attach the top cover 75 by pressing the prongs 76 into the slots 62 of the adjacent holding container, or the user may first re-attach the released holding container 60 to the assembly 59 before re-attaching the top cover 75.

7. DESCRIPTION OF OPERATION

In operation, the user can fasten the assembly 1 around a wrist or other body part, or to a piece of clothing. When the user desires to write a note or memo, the user pulls the drawer 21 out of the compartment section 20. The user can then remove a folded sheet of paper 38 or peel off a sheet of paper from a paper pad stored within the drawer 21. The drawer 21 may have hinged elevators 30 that raise the folded sheets of paper 38 for easy access and removal. The user then pushes the drawer 21 back into the slot 31 of the compartment section 20 and by grasping the spherical end 44 of the writing instrument 43, the user can remove the writing instrument 43 from the slot 42 of the holder 41 of the writing instrument section 40.

The user can now write a note or memo, return the writing instrument 43 to the slot 42 for storage thereof, and raise the top cover 10 of the shelf section 5, which enable the user to remove one of the holding containers 18 stored within the slots 13 formed in the shelf section 5. The user can re-fold the sheet of paper and insert the folded sheet of paper 38 into the slot 19 of one of the holding containers 18, which can be restored in the slot 13, traded or handed to another person for future reading. The user can also make several notes or memos that can be stored in the holding containers 18.

The assembly 1 provides the user with the ability to make notes or memos, while also providing a separate storage section for a note or memo for future reading. The alternate embodiment of the memo pad assembly 59 has holding containers 60 that can be easily separated from the compartment section 70. The holding containers 60, which are similar to the holding containers 18, but have prongs 61 extending from each of the bottom surface 63 of the holding containers 60. The prongs 61 can be removably, inserted into the slots 71 for attachment to the compartment section 70. The user can later simply detach the holding containers 60 from the compartment section 70 by pulling the holding containers 60 and releasing the prongs 61 out of the slots 71. When the user has inserted a note or memo into the slot 65 of one of the holding containers 60, the user can return and re-attach the holding container 60 to the compartment section 70 for future use, or can trade or hand the holding container 60 to another person for the other's use.

It is to be understood that while certain forms of this invention have been illustrated and described, the invention is not limited thereto, except insofar as such limitations are included in the following claims.

What is claimed and described to be secured by Letters Patent is as follows:

1. A memo pad assembly adapted to be worn around a person's wrist, ankle, and other body parts, and clothing, said memo pad assembly comprising:

(a) a plurality of containers having first slots formed within said containers;

(b) a strap having a center portion, and first and second ends having releasable securing means;

(c) a compartment section attached to said center portion and having a rear side with an outer surface, a second slot formed within said compartment section, and a drawer removably stored within said second slot;

(d) a plurality of sheets of paper removably stored within said drawer and being adapted to be removably inserted in said first slots of said containers;

(e) a writing instrument section located adjacent to said compartment section and comprising a writing instrument and a shelf extension, said shelf extension attached to said outer surface of said rear side of said compartment section and having a third slot formed in said shelf extension, said writing instrument adapted to be removably stored in said third slot; and (f) a shelf section located above said compartment section and having a plurality of extensions protruding from spaced apart sides, and a support end, said extensions attached to said support end and forming a plurality of fourth slots, said support end connected to said compartment section, each of said fourth slots adapted to receive one of said containers.

2. A memo pad assembly as set forth in claim 1 wherein said containers have a substantially thin, rectangular shape and are adapted to be removably inserted and stored within said fourth slots for future use.

3. A memo pad assembly as set forth in claim 1 wherein said strap is formed of flexible material.

4. A memo pad assembly as set forth in claim 1 wherein said compartment section has a substantially rectangular shape.

5. A memo pad assembly as set forth in claim 1 wherein said compartment section, said shelf extension and said shelf section are formed of a synthetic plastic material.

6. A memo pad assembly as set forth in claim 1 wherein said shelf section has a top lid that is adapted to cover said extensions and any of said containers removably inserted within said fourth slots, said top lid having a hinged end that is connected to said support end.

7. A memo pad assembly as set forth in claim 1 wherein said containers are formed of a clear material that is adapted to allow a user to see said paper removably inserted within said first slots of said containers.

8. A memo pad assembly as set forth in claim 6 wherein said containers and said top lid are adapted to hold and display a clock.

9. A memo pad assembly as set forth in claim 6 wherein said containers and said top lid are formed of a non-transparent material.

10. A memo pad assembly adapted to be worn around a person's wrist, an ankle, and other body parts, and clothing, said memo pad assembly comprising:

(a) a plurality of substantially thin rectangular containers having first slots formed within said containers;

(b) a fastening strap having a center portion and first and second ends having releasable securing means;

(c) a compartment section having a substantially rectangular shape attached to said center portion and having a rear side with an outer surface, a second slot formed within said compartment section, a drawer removably stored within said second slot and having means for sliding in and out of said second slot;

(d) a plurality of sheets of paper removably stored within said drawer and being adapted to be removably inserted in said first slots of said containers;

(e) a writing instrument section located adjacent to said compartment section and comprising a writing instrument and a shelf extension, said shelf extension attached to said outer surface of said rear side of said compartment section and having a third slot formed in said shelf extension, said writing instrument adapted to be removably stored within said third slot;

(f) a shelf section located above said compartment section and having a plurality of extensions protruding from spaced apart sides, a support wall and a top lid, said support wall having first and second spaced apart opposite ends, said first end connected to said compartment section, said second end connected to said top lid by hinged means, said extensions attached to said support wall with spaces in between each of said extensions and located between said top lid and said compartment section, said spaces forming a plurality of fourth slots, each of said fourth slots adapted to receive one of said containers;

(g) said containers being adapted to be removably inserted and stored within said fourth slots for future use; and (h) said top lid adapted to cover said extensions and any of said containers removably inserted within said fourth slots.

11. A memo pad assembly as set forth in claim 10 wherein said strap is formed of flexible material.

12. A memo pad assembly as set forth in claim 10 wherein said compartment section, said shelf extension and said shelf section are formed of a synthetic plastic material.

13. A memo pad assembly as set forth in claim 10 wherein said containers and said top lid are formed of a clear material that is adapted to allow a user to see through said containers and said top lid.

14. A memo pad assembly as set forth in claim 10 wherein said containers are adapted to hold and display entertainment pictures and information, said containers being formed of a non-transparent material, and said top lid adapted to hold and display a clock.

15. A memo pad assembly as set forth in claim 10 wherein said securing means of said strap includes VELCRO.

16. A memo pad assembly adapted to be worn around a person's wrist, ankle, and other body parts, and clothing, said memo pad assembly comprising:

(a) a plurality of containers having top and bottom surfaces, and first slots formed between said top and bottom surfaces, each of said containers adapted to be removably stacked on top of each other, said containers having a plurality of first prongs protruding from said bottom surfaces and a plurality of second slots formed on said top surfaces, said second slots adapted to releaseably receive said first prongs;

(b) a strap having a center portion, and first and second ends having releasable securing means;

(c) a compartment section attached to said center portion and having spaced apart first and second sides attached to a rear side with an outer surface, and a drawer, said first and second sides and said rear side forming a third slot, said drawer removably stored within said third slot, said second side having a plurality of fourth slots formed on said second side and adapted to releaseably receive said first prongs of one of said containers to removably attach said container to said compartment section;

(d) a plurality of sheets of paper removably stored within said drawer and being adapted to be removably inserted in said first slots of said containers; and (e) a writing instrument section located adjacent to said compartment section and comprising a writing instrument and a shelf extension, said shelf extension attached to said outer surface of said rear side of said compartment section and having a fifth slot formed in said shelf extension, said writing instrument adapted to be removably stored in said fifth slot.

17. A memo pad assembly as set forth in claim 16 wherein said containers are substantially thin and are formed of a clear material that is adapted to allow a user to see said paper removably inserted within said first slots of said containers.

18. A memo pad assembly as set forth in claim 16 wherein said strap is formed of flexible material.

19. A memo pad assembly as set forth in claim 16 wherein said compartment section has a substantially rectangular shape, and said containers are formed of a non-transparent material.

20. A memo pad assembly as set forth in claim 16 wherein said compartment section, said shelf extension and said containers are formed of a synthetic plastic material.

21. A memo pad assembly as set forth in claim 16 wherein said assembly has a top cover that has spaced apart first and second surfaces, said second surface has a plurality of second prongs protruding from said second surface, said second prongs adapted to be releaseably inserted into said second slots of one of said containers that has been removably attached to said compartment section, and said containers and said top cover are adapted to hold and display entertainment pictures and information.

* * * * *